US005394993A

United States Patent [19]

Gravell et al.

[11] Patent Number: 5,394,993

[45] Date of Patent: Mar. 7, 1995

[54] RACK FOR SUSPENDING AND SEALING BAGS

[76] Inventors: Glenn Gravell; Barb Gravell, both of 2155 Philipps Road, Box 886, Sooke, B.C., Canada, V0S 1N0

[21] Appl. No.: 92,413

[22] Filed: Jul. 16, 1993

[30] Foreign Application Priority Data

Jul. 16, 1992 [CA] Canada ..... 2074011

[51] Int. Cl.[6] ..... A47F 5/00

[52] U.S. Cl. ..... 211/12; 211/71; 211/89; 248/95

[58] Field of Search ..... 211/45, 89, 12, 46, 211/115, 95, 70, 94.5, 71, 163; 248/101, 95

[56] References Cited

U.S. PATENT DOCUMENTS

| | | | |
|---|---|---|---|
| 2,908,398 | 10/1959 | Snyder | 211/89 X |
| 3,472,389 | 10/1969 | Lowe | 211/70 |
| 4,105,127 | 8/1978 | Holl | 211/89 X |
| 4,787,522 | 11/1988 | Nocek et al. | 211/71 |
| 4,793,495 | 12/1988 | Preu | 211/46 X |
| 4,832,290 | 5/1989 | Baglio | 248/95 |
| 4,836,389 | 6/1989 | Poulton | 211/46 X |
| 4,998,630 | 3/1991 | Schwartz | 211/71 |
| 5,031,782 | 7/1991 | Minervini | 211/46 |

*Primary Examiner*—Robert W. Gibson, Jr.

[57] ABSTRACT

It is often inconvenient to store bags of spices, potato chips, etc., particularly once the bags have been opened. Accordingly, there is disclosed herein a rack for suspending and sealing bags. The rack includes a plurality of horizontal clamps adapted to suspend and to seal bags, and support means adapted to support the clamps above a ground surface. One embodiment of the invention includes a plurality of radially oriented horizontal clamps adapted to suspend and to seal bags, each of the clamps having both a generally uniform cross-section with a discontinuity adapted to receive a bag, and a first end which is angled downwardly and inwardly. The rack also includes a support means adapted rotatably to support the clamps above a ground surface, and further adapted to be suspended from a generally horizontal surface, such as the underside of a shelf.

8 Claims, 2 Drawing Sheets

RACK FOR SUSPENDING AND SEALING BAGS

FIELD OF THE INVENTION

The present invention relates to a rack for suspending and sealing bars.

BACKGROUND OF THE INVENTION

It is often inconvenient to store bars of spices, potato chips, etc., particularly once the bags have been opened. Such bars are often stored in drawers or on shelves, and this arrangement can be rather messy and disorganized. Furthermore, once the bags have been opened, the contents thereof may not only be spilt but may also deteriorate from exposure to the atmosphere.

It is known to seal bars of potato chips with a spring loaded clip. However, the problem of convenient storage is not solved in this way.

It is also known to store various articles by suspending them in a radial formation. For example, Canadian Patent No. 56,086 (McIntyre) teaches a wardrobe in which clothes may be suspended radially from hooks attached to a suspended rotatable rack.

Canadian Patent No. 76,740 (Edwards) teaches a suspended rotatable broom holder from which brooms may be suspended in radial tows from pairs of horizontal parallel arms.

Canadian Patent No. 190,562 (Nief) teaches a suspended clothes drier from which clothes may be suspended radially from horizontal arms.

U.S. Pat. No. 1,948,014 (Tuttle) teaches a suspended rotatable clothes drier from which clothes may be suspended radially from horizontal arms.

U.S. Pat. No. 2,961,715 (Traumuller) teaches a rotatable cup or article supporting device. The device is, essentially, a plate or disk designed to be rotatably mounted at its centre beneath a horizontal support such as a shelf, the articles being suspended from hooks attached to the underside of the disk.

U.S. Pat. No. 2,765,927 (Haley) teaches a suspended rack from which belts are suspended from loops, and ties are suspended from annular friction clamps.

None of the above patents discloses an apparatus suitable for storing opened bags of spices, potato chips, etc., and for keeping the contents thereof fresh. I have found, however, that the problems of storage and sealing can be solved by providing a rack for suspending and sealing bags. Accordingly, the present invention relates to a rack for suspending and sealing bags, comprising: a plurality of horizontal clamping means adapted to suspend and to seal bags; and support means adapted to support said clamping means above a ground surface.

SUMMARY OF THE INVENTION

The present invention further relates to a rack for suspending and sealing bags, comprising: a plurality of radially oriented horizontal clamping means adapted to suspend and to seal bags, each of said clamping means having both a generally uniform cross-section with a discontinuity adapted to receive a bag, and a first end which is angled downwardly and inwardly; and support means adapted rotatably to support said clamping means above a ground surface, and further adapted to be suspended from a generally horizontal surface.

The present invention further relates to a rack for suspending and sealing bags, comprising a horizontally oriented disk adapted to rotate horizontally about its centre, and further adapted to be suspended below a generally horizontal surface, said disk having a plurality of radially oriented slits adapted to suspend and to seal bags.

BRIEF DESCRIPTION OF THE DRAWINGS

The embodiments of the invention will now be described by way of example with reference to the accompanying drawings, in which.

Figure 1:
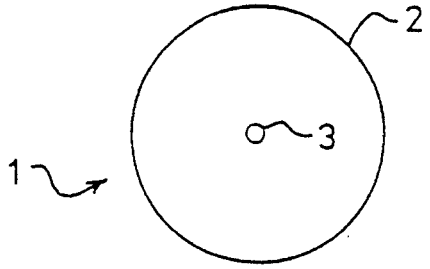
FIG. 1 is a top plan view of one embodiment of the rack.
Figure 2:
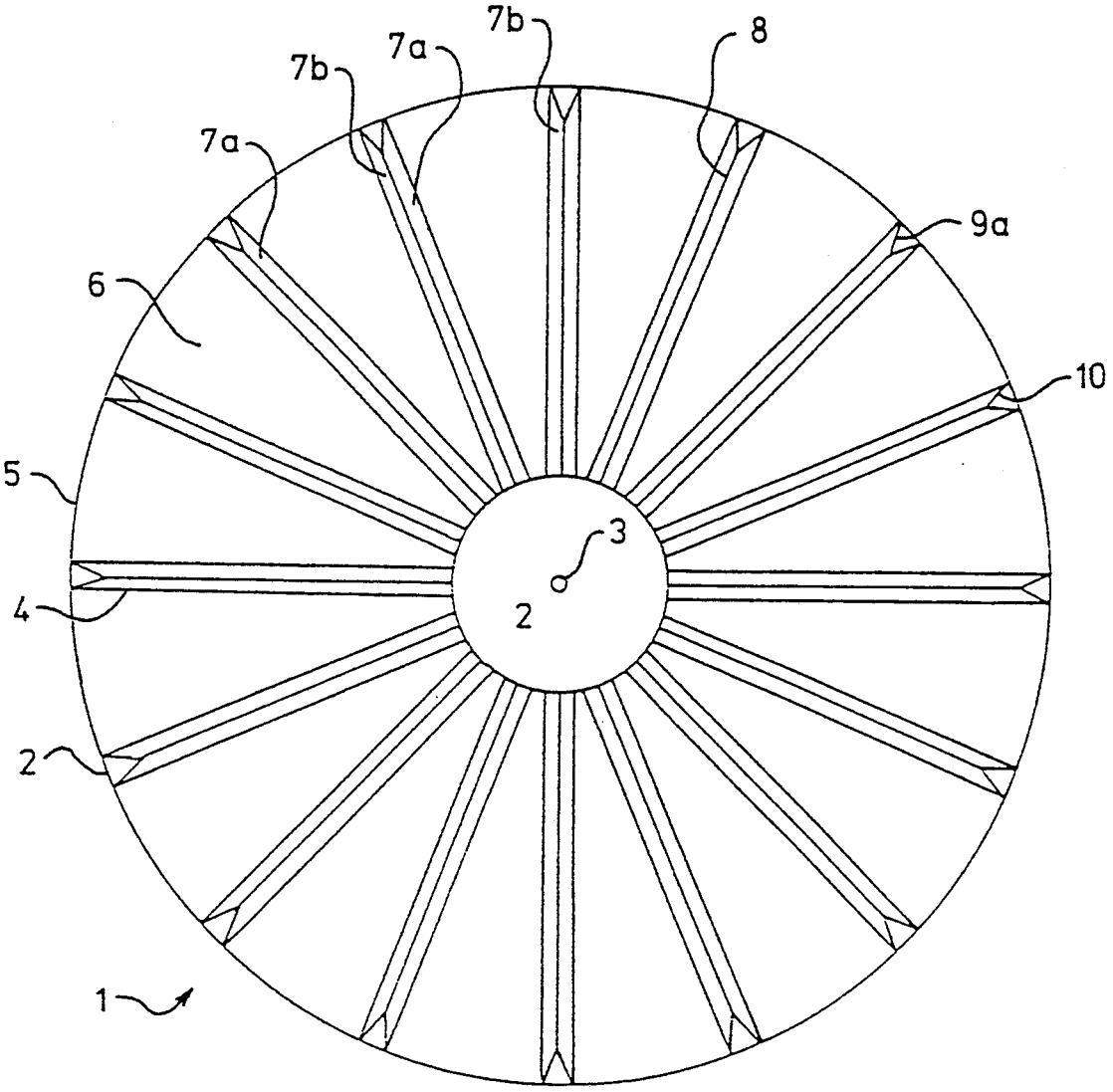
FIG. 2 is a bottom plan view of the embodiment of FIG. 1.
Figure 3:
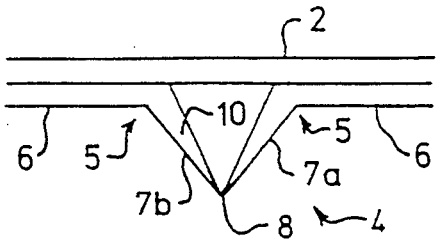
FIG. 3 is a partial end view of one of the clamps illustrated in FIG. 2.
Figure 4:
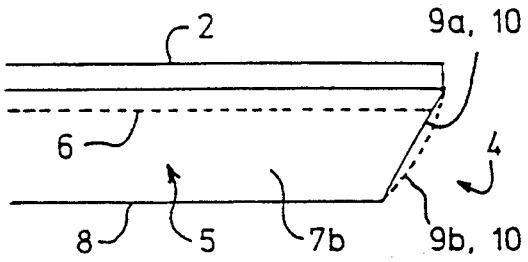
FIG. 4 is a partial side view of the clamp illustrated in FIG. 3.

Similar references are used in different figures to denote similar components.

DETAILED DESCRIPTION OF THE INVENTION

Referring now to FIGS. 1 through 4, the illustrated rack 1 comprises a disk 2 at the centre of which is a hole 3. The hole 3 enables the rack 1 to be rotatably suspended from a horizontal surface (not shown), such as by a screw (not shown). Alternatively, the rack 1 may be suspended from a wall mounted bracket (not shown), or from a stand (not shown) which rests on a ground surface and extends vertically upwards therefrom.

Depending from the underside of the disk 2 are a plurality of co-planar clamps 4 which are formed from clamp segments 5. Each clamp segment 5 comprises a generally triangular flat surface 6 and two angled clamp elements 7*a* and 7*b*. Each clamp element 7*a* meets the clamp element 7*b* of the adjoining clamp segment 5 at a discontinuity 8. The force that adjacent clamp elements 7*a* and 7*b* exert on each other at the discontinuities 8 is determined by the resiliency of the material (in this case plastic) from which the clamp segments 5 are made. This force is such that the top of a plastic spice bag (not shown) may be inserted into a discontinuity 8 so that the upper portion of the bag is sealed by and suspended from the associated clamp 4.

Each clamp 4 has an angled end 9*a* or rounded end 9*b* (see FIG. 4) which facilitates the insertion of a bag into the discontinuity 8 without damaging the material comprising the bag. Insertion is further facilitated by providing rounded edges 10.

Figure 5:
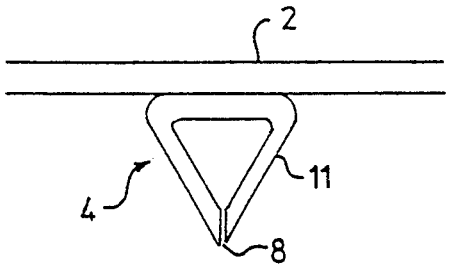
FIG. 5 is a partial end view of an alternative embodiment of the clamp illustrated in FIGS. 3 and 4.

FIG. 5 illustrates an alternative embodiment of a clamp 4 wherein, instead of being formed from two adjacent clamp segments 5, each clamp 4 is a self-contained unit 11 with a uniform triangular cross-section.

Figure 6:
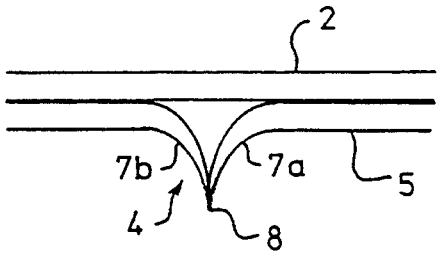
FIG. 6 is a partial end view of a further alternative embodiment of the clamps illustrated in FIGS. 3, 4, and 5.

FIG. 6 illustrates a further alternative embodiment of a clamp 4 wherein adjacent clamp elements 7*a* and 7*b* are curved instead of angled in order to make more gentle the contact between the clamp 4 and the bag.

Figure 7:
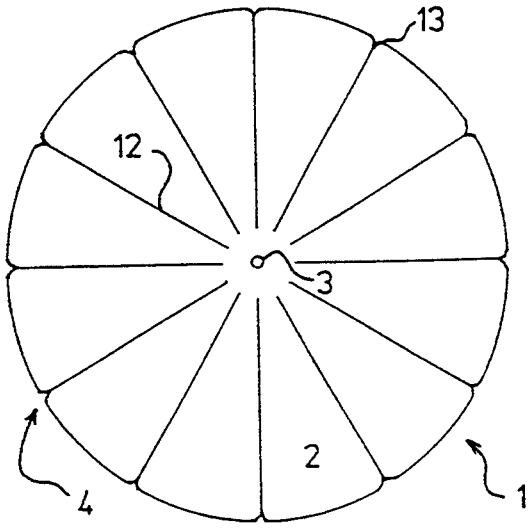
FIG. 7 is a bottom plan view of an alternative embodiment of the rack.
Figure 8:
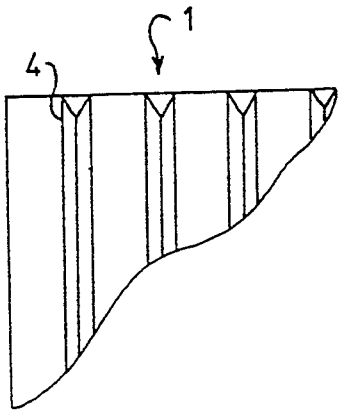
FIG. 8 is a partial bottom plan view of a further alternative embodiment of the rack.

FIG. 7 illustrates a further alternative embodiment of a rack 1 wherein the clamps 4 simply comprise slits 12 which are formed in the disk 2 and which are analogous to the discontinuities 8 of the above described embodiments. Rounded corners 13 facilitate the insertion of bags into the slits 12. The force exerted by the disk 2 at the slits 12 is determined by the resiliency of the material (in this case plastic) from which the disk 2 is made. This force is such that the top of a plastic spice bag may be inserted into a slit 12 such that the upper portion of the bag is sealed by and suspended from the disk 2.

Although the illustrated embodiments are round and have radially oriented clamps 4, a rack 1 for suspending and sealing bags can have any number of shapes. For example, as illustrated in FIG. 9, a rack 1 which is intended to be fixed to the underside of a cupboard can be rectangular in shape and have clamps 1 arranged parallel to each other. Similarly, a rack 1 which is intended to be suspended from a wall-mounted bracket can be semicircular in shape and have clamps 4 arranged radially.

Numerous modifications, variations and adaptations may be made to the particular embodiments of the invention described above without departing from the scope of the invention, which is defined in the claims.

We claim:

1. A rack for suspending and sealing flexible bags, comprising:

support means mountable in a substantially horizontal plane;

a plurality of clamping means disposed on said support means, each of said clamping means comprising:

(a) a respective pair of opposed cooperating clamp elements defining a discontinuity for clampingly receiving therein at least an upper portion of a bag, said clamp elements being resiliently biased together along said discontinuity whereby the bag can be substantially sealed along the length of said discontinuity, and can be suspended below said support means; and (b) an entry zone proximal an edge of said support means, for guiding a portion of a bag towards and into an end of said discontinuity, whereby the bag can be readily inserted into said clamping means.

2. A rack as defined in claim 1, wherein said clamp elements extend downwards from said support means and toward each other to define said discontinuity near a lower limit thereof, an end of each of said clamp elements being angled away from the edge of said support means so as to define an entry zone which is generally V-shaped in a horizontal plane.

3. A rack as defined in claim 2, wherein the end of each of said clamp elements defining said entry zone is substantially straight.

4. A rack as defined in claim 2, wherein the end of each of said clamp elements defining said entry zone is convexly curved.

5. A rack as defined in claim 1, wherein said support means is generally disc-shaped, said plurality of clamping means being oriented substantially radially on said support means.

6. A rack as defined in claim 5, wherein said support means comprises rotary mounting means disposed near the center of said support means, whereby said support means can be operatively mounted for rotation in a substantially horizontal plane.

7. A rack as defined in claim 1, wherein said discontinuity is defined by a slit formed in said support means, clamp elements formed by walls of said slit defining said discontinuity, said entry zone being defined by said slit widening into a generally V-shape near an edge of said support means.

8. A rack as defined in claim 1, wherein said support means is generally rectangular in shape, said plurality of clamping means being oriented substantially parallel to each other.

* * * * *